US008157408B2

(12) United States Patent
Yang et al.

(10) Patent No.: US 8,157,408 B2
(45) Date of Patent: Apr. 17, 2012

(54) LIGHTING APPARATUS

(75) Inventors: He-Shun Yang, HsinChu (TW); Shih-Chin Chou, HsinChu (TW); Meng-Chai Wu, HsinChu (TW)

(73) Assignee: Lextar Electronics Corporation, Hsinchu (TW)

( * ) Notice: Subject to any disclaimer, the term of this patent is extended or adjusted under 35 U.S.C. 154(b) by 298 days.

(21) Appl. No.: 12/703,284

(22) Filed: Feb. 10, 2010

(65) Prior Publication Data

US 2011/0194278 A1 Aug. 11, 2011

(51) Int. Cl.
*F21V 21/00* (2006.01)

(52) U.S. Cl. ..... 362/217.13; 362/217.12; 362/659

(58) Field of Classification Search ..... 362/217.01, 362/221, 222, 217.1, 217.12, 217.13, 659, 362/249.02

See application file for complete search history.

(56) References Cited

U.S. PATENT DOCUMENTS

| | | | | |
|---|---|---|---|---|
| 7,052,171 | B1 * | 5/2006 | Lefebvre et al. | 362/649 |
| 7,270,443 | B2 | 9/2007 | Kurtz et al. | |
| 7,594,738 | B1 * | 9/2009 | Lin et al. | 362/249.02 |
| 2009/0091929 | A1 | 4/2009 | Faubion | |
| 2009/0159919 | A1 | 6/2009 | Simon et al. | |

* cited by examiner

*Primary Examiner* — David V Bruce
(74) *Attorney, Agent, or Firm* — WPAT, P.C.; Anthony King

(57) ABSTRACT

A lighting apparatus includes a housing, a light source disposed in the housing and at least one adjustable assembly. The adjustable assembly disposed at an end of the housing includes a connection element fixed to the end, a cap capping the connection element, at least one electrical terminal electrically connected to the light source and a detachable fixing element. The cap includes a side wall, an end wall and an opening disposed at the side wall. The side wall is disposed at the end wall to which the opening is opposite. The connection element passes through the opening. The electrical terminal disposed at the end wall extends outside the cap. The detachable fixing element passes through the side wall to detachably fix the cap to the connection element. When the detachable fixing element is detached, the housing and the connection element are adapted to be rotated relative to the cap.

11 Claims, 23 Drawing Sheets

LIGHTING APPARATUS

BACKGROUND

1. Field of the Invention

The present invention relates generally to an electrical apparatus. More particularly, the present invention relates to a lighting apparatus.

2. Detailed Description of the Related Art

Commercial light fixtures commonly use fluorescent lamps or incandescent lamps to radiate light for illumination. These lighting fixtures have the common drawbacks of high power consumption, quick light attenuation, short service life, fragility, and the inability to be reclaimed. Light emitting diode elements (hereinafter LED elements) may be used to replace fluorescent or incandescent bulbs to obtain the environmental and economic benefits of LED technology. However, LED elements are directional and when used with exiting light fixtures, they do not necessarily provide the illumination where it is needed.

Standard light tubes are mounted in a light fixture by means of sliding connector pins into end sockets and then turning the tube 90 degrees so that the pins engage electrical contacts in the sockets. The lamp tube emits light omni-directionally and its orientation in the sockets is of no consequence, making orientation of pin connectors on different models of fixtures inconsequential. However, LED elements emit light generally at a narrowly-angled conical path. An LED lighting tube retrofitted into the exiting light fixture may not be oriented to emit light in the desired direction as the angular presentation of the light to the surface to be illuminated can be offset by the variation of the pin connectors.

BRIEF SUMMARY

The present invention is directed to provide a lighting apparatus with an adjustable assembly.

In one embodiment, a lighting apparatus includes a housing, a light source and at least one adjustable assembly. The light source is disposed in the housing. The adjustable assembly is disposed at an end of the housing and includes a connection element, a cap, at least one electrical terminal and a detachable fixing element. The connection element is fixed to the end of the housing. The cap caps the connection element. The cap includes a side wall, an end wall and an opening. The side wall is disposed at the end wall. The opening is disposed at the side wall and opposite to the end wall. The connection element passes through the opening. The electrical terminal is disposed at the end wall and extends outside the cap. The electrical terminal is electrically connected to the light source. The detachable fixing element passes through the side wall to detachably fix the cap to the connection element. When the detachable fixing element is detached, the housing and the connection element are adapted to be rotated relative to the cap.

In an embodiment of the present invention, the adjustable assembly further includes an auxiliary central shaft passing through the end wall to be fixed to the connection element. When the detachable fixing element is detached, the housing, the connection element and the auxiliary central shaft are adapted to be rotated relative to the cap.

In an embodiment of the present invention, the auxiliary central shaft includes a through portion and an end portion. The through portion passes through the end wall to be fixed to the connection element. The end portion is disposed at an end of the through portion. At least part of the end wall is restricted between the end portion and the connection element.

In an embodiment of the present invention, the cap further includes a plurality of clasps disposed at the side wall and the clasps clasp the connection element.

In an embodiment of the present invention, the clasps are disposed at an inner surface of the side wall and adjacent to the opening.

In an embodiment of the present invention, the adjustable assembly further includes an electrical conductive module disposed in the cap. The electrical conductive module includes a first disk, a second disk and a disk spring. The first disk is disposed at an inner surface of the end wall and electrically connected to the electrical terminal. The second disk is fixed to the connection element and electrically connected to the light source. The disk spring is disposed between the first disk and the second disk and electrically connects the first disk and the second disk.

In another embodiment, a lighting apparatus includes a housing, a light source and at least one adjustable assembly. The light source is disposed in the housing. The adjustable assembly is disposed at an end of the housing and includes a connection element, a cap, at least one electrical terminal, an auxiliary central shaft and a ratchet. The connection element is fixed to the end of the housing. The cap caps the connection element. The cap includes a side wall, an end wall and an opening. The side wall is disposed at the end wall. The opening is disposed at the side wall and opposite to the end wall. The connection element passes through the opening. The electrical terminal is disposed at the end wall and extends outside the cap. The electrical terminal is electrically connected to the light source. The auxiliary central shaft includes a through portion and an end portion. The through portion passes through the end wall to be fixed to the connection element. The end portion is disposed at an end of the through portion. At least part of the end wall is restricted between the end portion and the connection element. The housing, the connection element and the auxiliary central shaft are adapted to be rotated relative to the cap. The ratchet includes a gear and a positioning element engaged with the gear. The gear is disposed at an inner surface of the side wall and the positioning element is disposed at the connection element, or the gear is disposed at the connection element and the positioning element disposed at the side wall extends from the inner surface of the side wall into the cap.

In an embodiment of the present invention, the adjustable assembly further includes an electrical conductive module disposed in the cap. The electrical conductive module comprises a first disk, a second disk and a disk spring. The first disk is disposed at an inner surface of the end wall and electrically connected to the electrical terminal. The second disk is fixed to the connection element and electrically connected to the light source. The disk spring is disposed between the first disk and the second disk and electrically connects the first disk and the second disk.

In another embodiment, a lighting apparatus includes a housing, a light source and at least one adjustable assembly. The light source is disposed in the housing. The adjustable assembly is disposed at an end of the housing and includes a connection element, a cap, at least one electrical terminal and a ratchet. The connection element is fixed to the end of the housing. The cap caps the connection element. The cap includes a side wall, an end wall, an opening and a plurality of clasps. The side wall is disposed at the end wall. The opening is disposed at the side wall and opposite to the end wall. The clasps are disposed at the side wall. The connection element passes through the opening. The clasps clasp the connection element. The housing and the connection element are adapted to be rotated relative to the cap. The electrical terminal is disposed at the end wall and extends outside the cap. The electrical terminal is electrically connected to the light source. The ratchet includes a gear and a positioning element engaged with the gear. The gear is disposed at an inner surface of the side wall and the positioning element is disposed at the connection element, or the gear is disposed at the connection element and the positioning element disposed at the side wall extends from the inner surface of the side wall into the cap.

In an embodiment of the present invention, the clasps are disposed at the inner surface of the side wall and adjacent to the opening.

In an embodiment of the present invention, the electrical conductive module includes a first disk, a second disk and a disk spring. The first disk is disposed at an inner surface of the end wall and electrically connected to the electrical terminal. The second disk is fixed to the connection element and electrically connected to the light source. The disk spring is disposed between the first disk and the second disk and electrically connects the first disk and the second disk.

Because the housing and the connection element of the lighting apparatus of each of the embodiments can be rotated relative to the cap, the lighting apparatus of each of the embodiments is applicable to the present exiting light fixture and the light from the lighting source can be directed to illuminate the desired surface or area.

Other objectives, features and advantages of the present invention will be further understood from the further technological features disclosed by the embodiments of the present invention wherein there are shown and described preferred embodiments of this invention, simply by way of illustration of modes best suited to carry out the invention.

BRIEF DESCRIPTION OF THE DRAWINGS

The accompanying drawings are included to provide a further understanding of the invention, and are incorporated in and constitute part of this specification. The drawings illustrate embodiments of the invention and, together with the description, serve to explain the principles of the invention.

DETAILED DESCRIPTION

Reference will now be made to the drawings to describe exemplary embodiments of the present sensing system, in detail. The following description is given by way of example, and not limitation.

First Embodiment

Figure 1A:
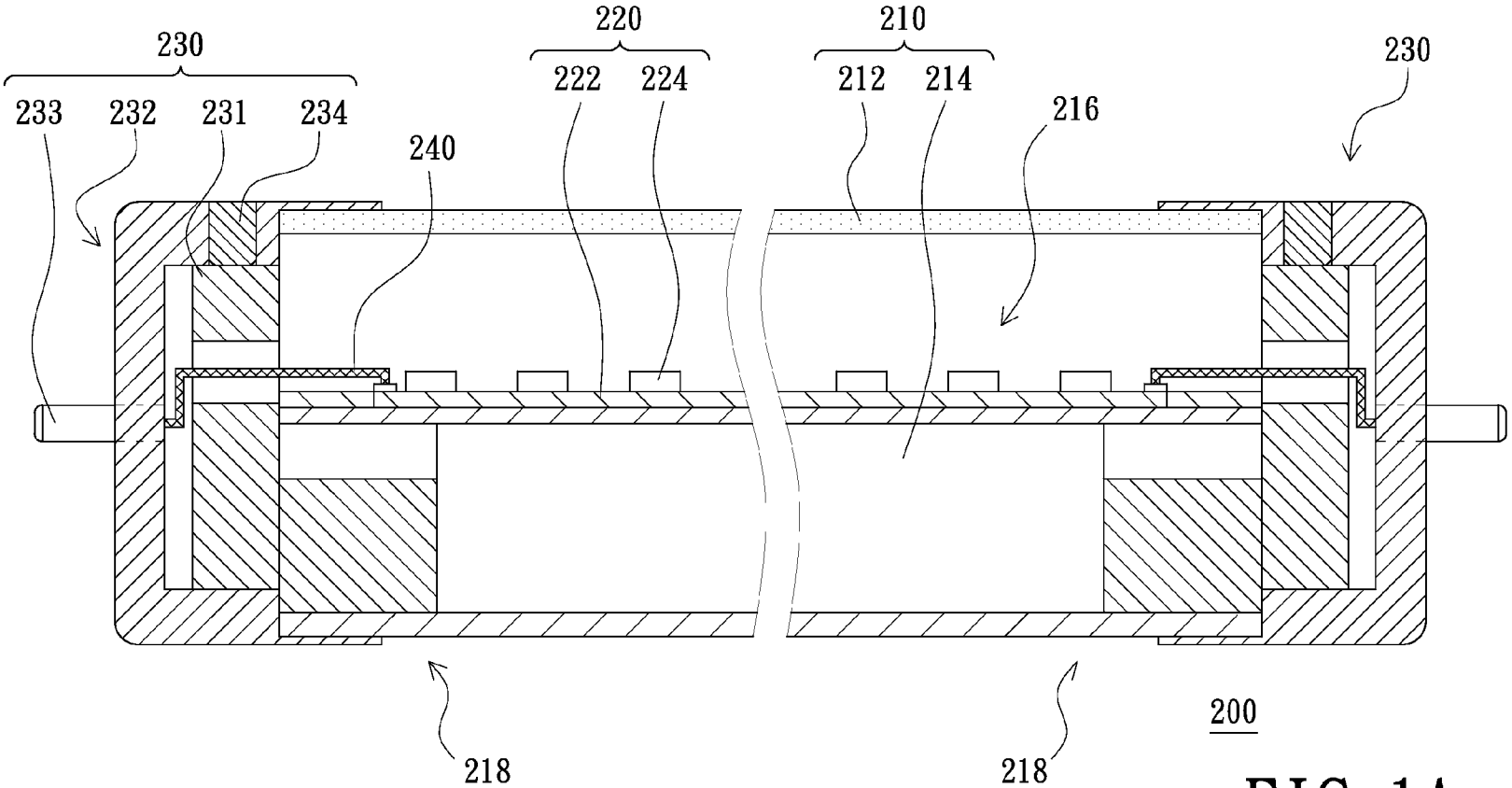
FIG. 1A is a schematic cross-sectional view of a lighting apparatus of a first embodiment of the present invention.
Figure 1B:
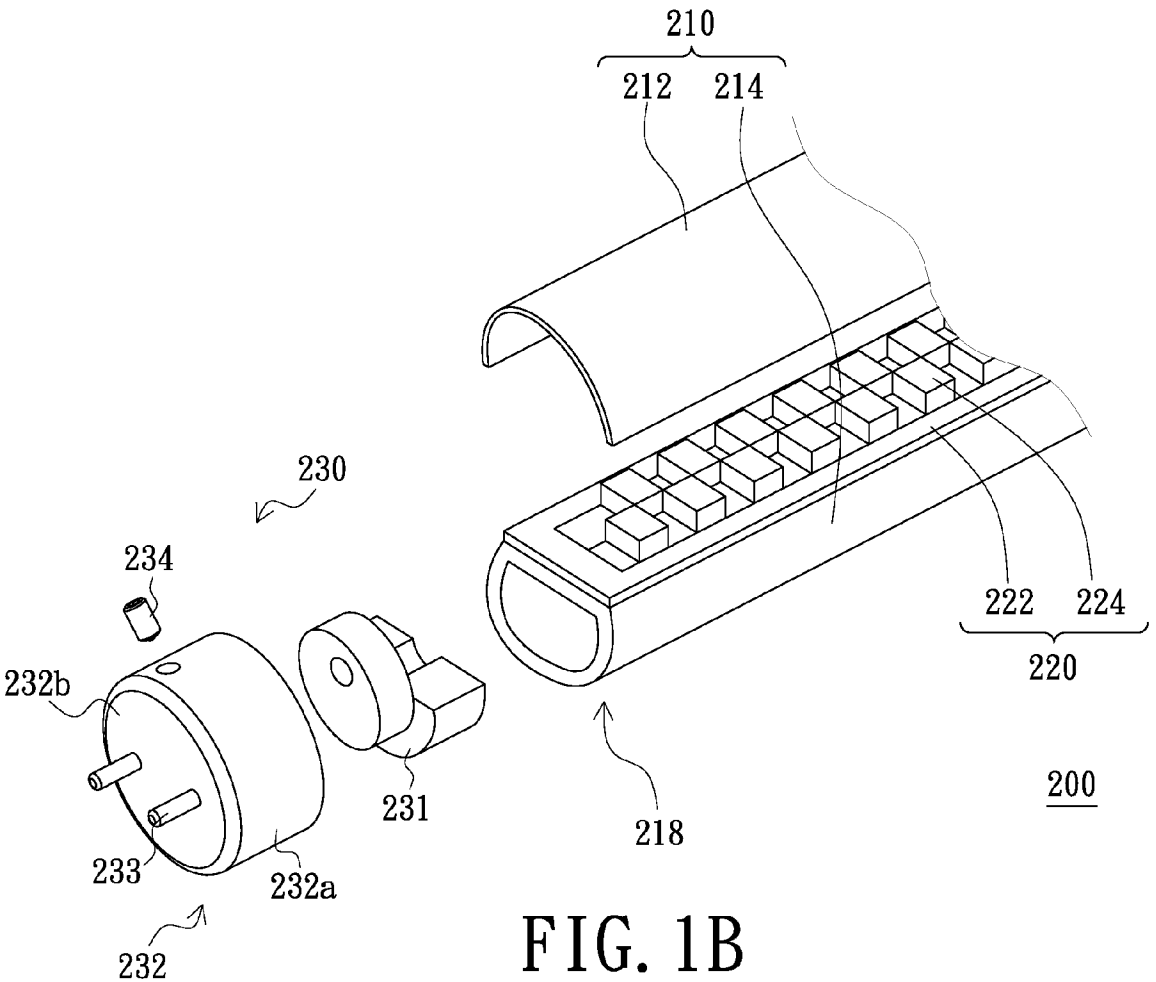
FIG. 1B is a schematic three-dimensional partially-exploded view of the lighting apparatus of FIG. 1A.
Figure 1C:
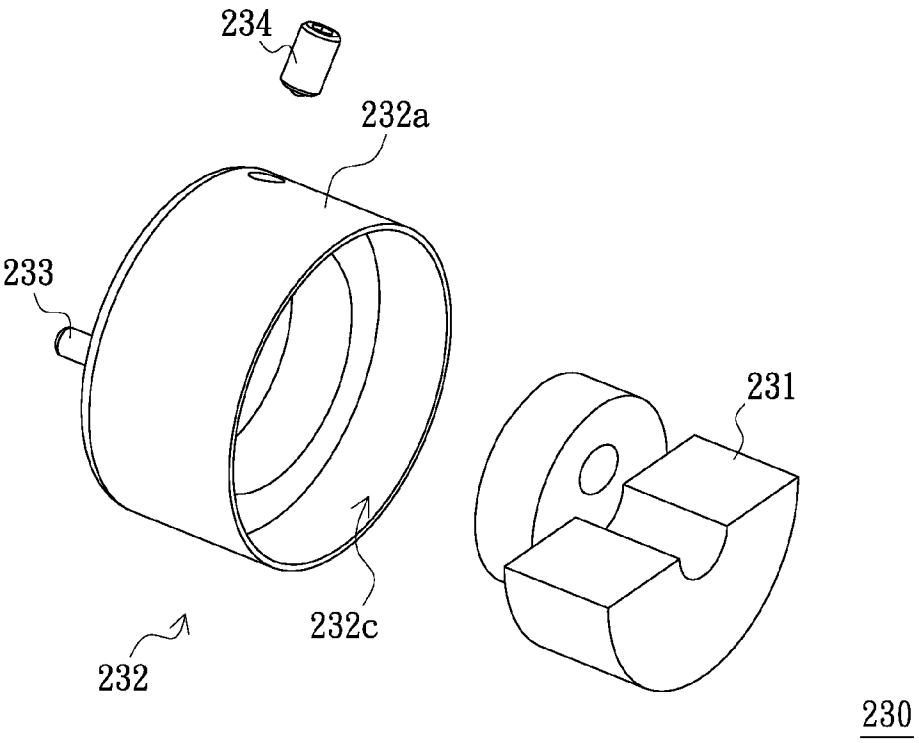
FIG. 1C is a schematic three-dimensional exploded view of the adjustable assembly of FIG. 1A.

FIG. 1A is a schematic cross-sectional view of a lighting apparatus of a first embodiment of the present invention. FIG. 1B is a schematic three-dimensional partially-exploded view of the lighting apparatus of FIG. 1A. FIG. 1C is a schematic three-dimensional exploded view of the adjustable assembly of FIG. 1A. Referring to FIGS. 1A, 1B and 1C, a lighting apparatus 200 includes a housing 210, a light source 220, at least one adjustable assembly 230 (two adjustable assemblies 230 are schematically shown in FIG. 1A) and a plurality of wires 240 (not shown in FIG. 1B). The housing 210 includes a transparent front portion 212 and a rigid back portion 214. The rigid back portion 214 may be a heat sink. The transparent front portion 212 may be slidingly disposed at the rigid back portion 214 such that the transparent front portion 212 and the rigid back portion 214 together form an accommodating space 216.

The light source 220 is disposed in the housing 210. Particularly, the light source 220 includes a circuit board 222 and a plurality of LED elements 224. The LED elements 224 are electrically disposed on the circuit board 222. The circuit board 222 is disposed on the rigid back portion 214 such that the light source 220 is located in the accommodating space 216. When the LED elements 224 operate to illuminate light, the heat generated by the LED elements 224 can be transferred to the outside environment through a plurality of heat conductive channels (not shown) of the circuit board 222 and the rigid back portion 214 such as the heat sink.

The adjustable assemblies 230 are disposed two opposite ends 218 of the housing 210. Each of the adjustable assemblies 230 includes a connection element 231, a cap 232, at least one electrical terminal 233 (two electrical terminals 233 are schematically illustrated in FIG. 1B) and a detachable fixing element 234. The connection elements 231 are inserted into the rigid back portion 214 to be fixed to the ends 218 of the housing 210, respectively. Each of the caps 232 includes a side wall 232*a*, an end wall 232*b* and an opening 232*c*. The side wall 232*a* of each of the caps 232 is disposed at the corresponding end wall 232*b*. The opening 232*c* of each of the caps 232 is disposed at the corresponding side wall 232*a* and opposite to the corresponding end wall 232*b*. The connection elements 231 pass through the openings 232*c*, respectively and the caps 232 cap the connection elements 231, respectively.

In each of the adjustable assemblies 230, the electrical terminals 233, such as pins, are disposed at the end wall 232*b* and extend outside the cap 232. The electrical terminals 233 of each of the adjustable assemblies 230 are electrically connected to the circuit board 222 of the light source 220 through one of the wires 240. The electrical terminals 233 of each of the adjustable assemblies 230 can be inserted into one of two sockets of a standard fluorescent or incandescent light fixture (not shown).

In each of the adjustable assemblies 230, the detachable fixing element 234, such as a screw, passes through the side wall 232*a* of the cap 232 to detachably fix the cap 232 to the connection element 231. When the detachable fixing elements 234 are detached, the housing 210 and the connection elements 231 are adapted to be rotated relative to the caps 232 by a user by applying a rotational force on the housing 210 to direct the light from the LED elements 224 to illuminate the desired surface or area. It should be noted that the housing 210 and the connection elements 231 are adapted to be rotated about some angular degrees to ensure that the wires 240 are not broken during the rotation. However, when the housing 210 and the connection elements 231 are adjusted to an adequate position, the user can fix the detachable fixing elements 234 again such that the final position of the housing 210 and the connection elements is maintained.

Because the detachable fixing elements 234 can be detached such that the housing 210 and the connection elements 231 can be rotated relative to the caps 232, the lighting apparatus 200 of the first embodiment is applicable to the present exiting light fixture and the light from the lighting source 220 can be directed to illuminate the desired surface or area.

Second Embodiment

Figure 2A:
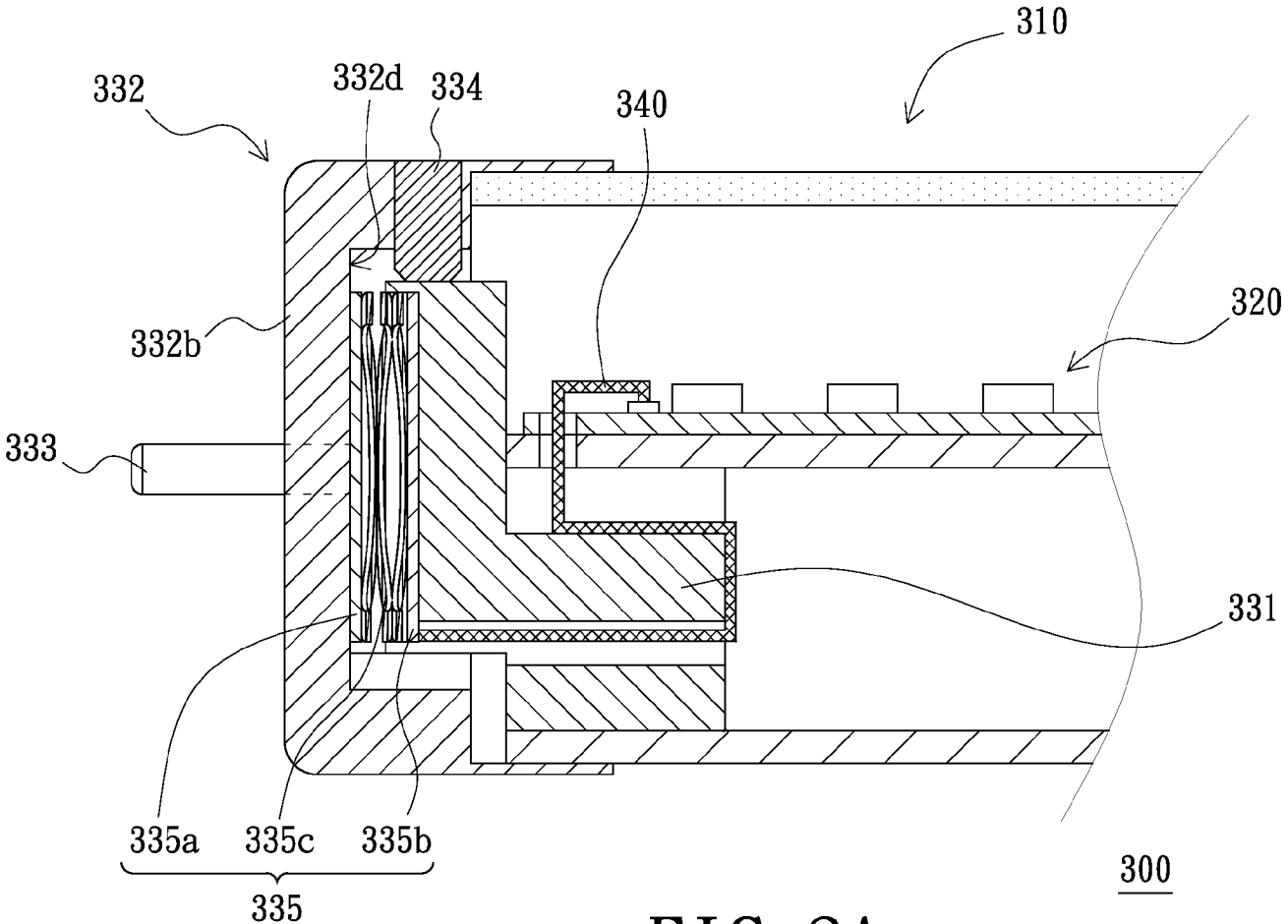
FIG. 2A is a schematic cross-sectional view of a lighting apparatus of a second embodiment of the present invention.
Figure 2B:
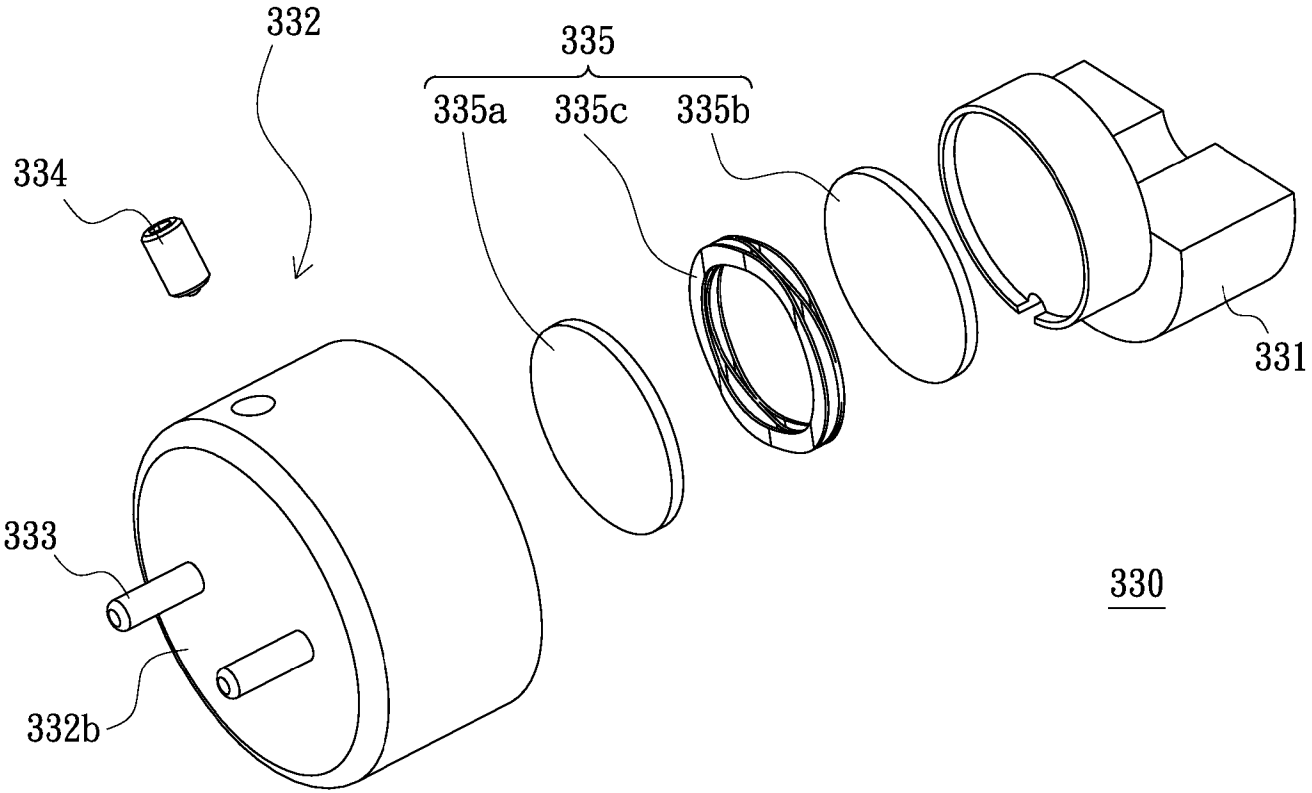
FIG. 2B is a schematic three-dimensional exploded view of the adjustable assembly of FIG. 2A.
Figure 2C:
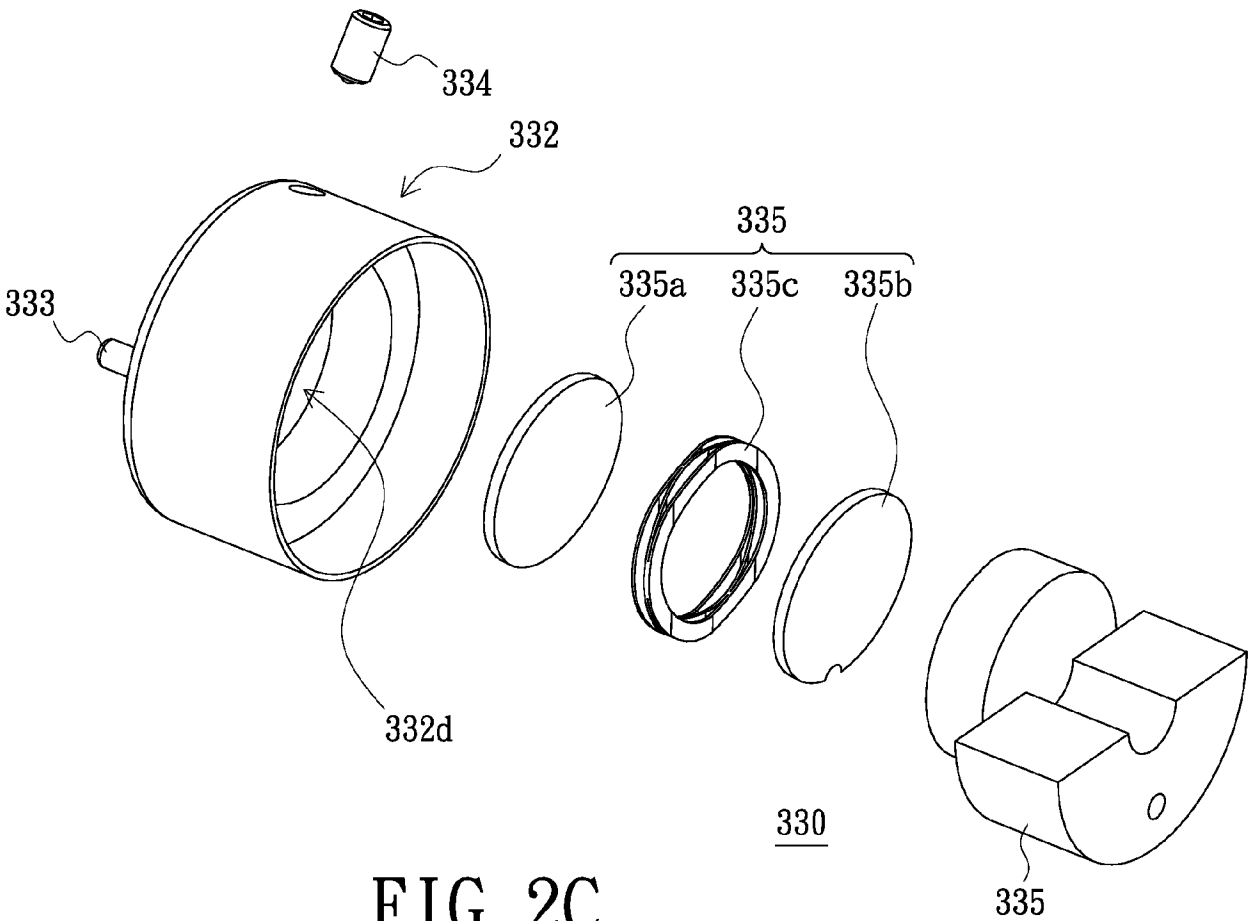
FIG. 2C is another schematic three-dimensional exploded view of the adjustable assembly of FIG. 2A.

FIG. 2A is a schematic cross-sectional view of a lighting apparatus of a second embodiment of the present invention. FIG. 2B is a schematic three-dimensional exploded view of the adjustable assembly of FIG. 2A. FIG. 2C is another schematic three-dimensional exploded view of the adjustable assembly of FIG. 2A. Referring to FIGS. 2A, 2B and 2C, the main difference between the lighting apparatus 300 of the second embodiment and the lighting apparatus 200 of the first embodiment lies in that each of the adjustable assemblies 330 of the lighting apparatus 300 further includes an electrical conductive module 335 disposed in the cap 332.

In each of the adjustable assemblies 330, the electrical conductive module 335 includes a first disk 335*a*, a second disk 335*b* and a disk spring 335*c*. The first disk 335*a* is disposed at an inner surface 332*d* of the end wall 332*b* and electrically connected to the electrical terminals 333. The second disk 335*b* is fixed to the connection element 331 and electrically connected to the light source 310 through one of the wires 340 (not shown in FIG. 2B and FIG. 2C). The disk spring 335*c* is disposed between the first disk 335*a* and the second disk 335*b* and electrically connects the first disk 335*a* and the second disk 335*b*.

It should be noted that when the detachable fixing elements 334 are detached, the housing 310 and the connection elements 331 are adapted to be rotated relative to the caps 332 and each of the second disk 335*b* are adapted to be rotated relative to the corresponding first disk 335*a*. At this time, each of the wires 340 is almost not twisted. Accordingly, compared to the lighting apparatus 200 of the first embodiment, the housing 310 and the connection elements 331 of the lighting apparatus 300 of the present embodiment can be rotated about 360 angular degrees back and forth such that it is more convenient for the user to adjust the position of the housing 310 and the direction of light from the light source 320.

Third Embodiment

Figure 3A:
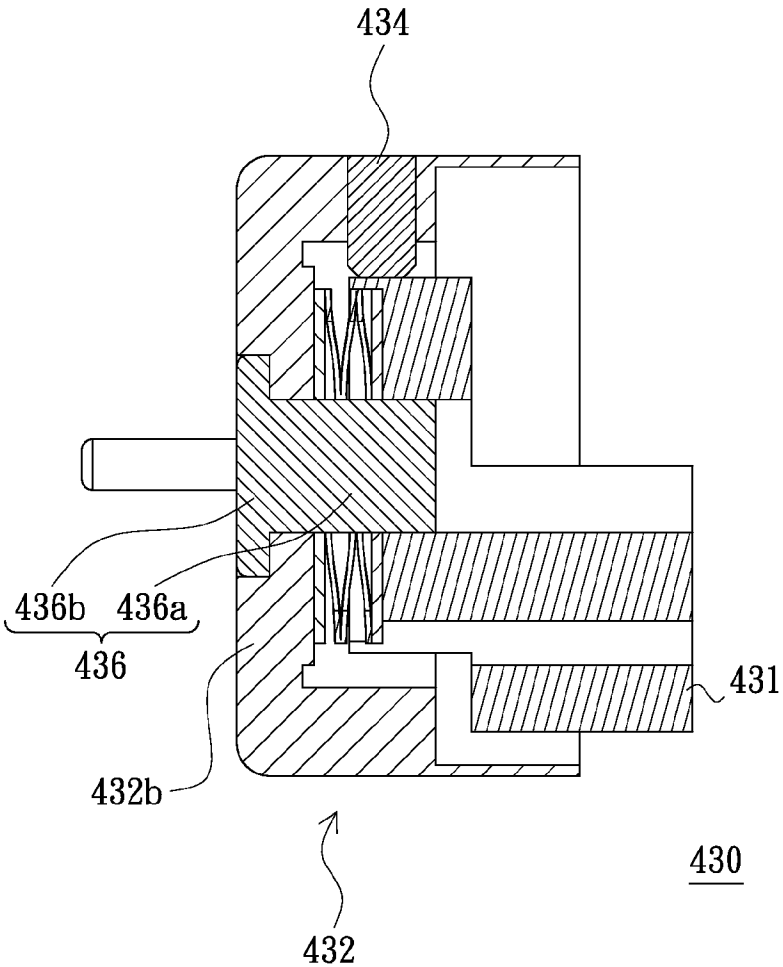
FIG. 3A is a schematic cross-sectional view of an adjustable assembly of a third embodiment of the present invention.
Figure 3B:
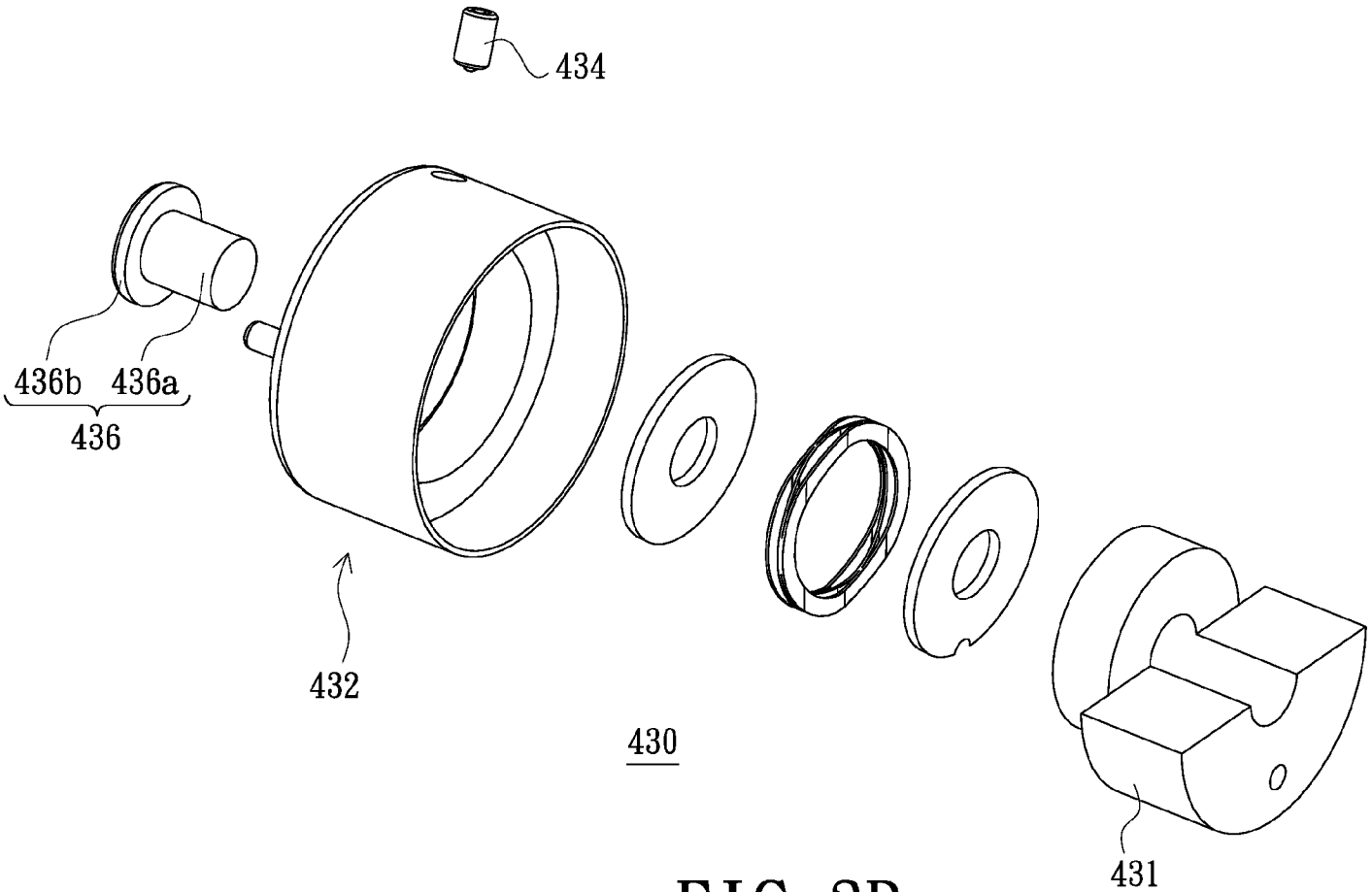
FIG. 3B is a schematic three-dimensional exploded view of the adjustable assembly of FIG. 3A.
Figure 3C:
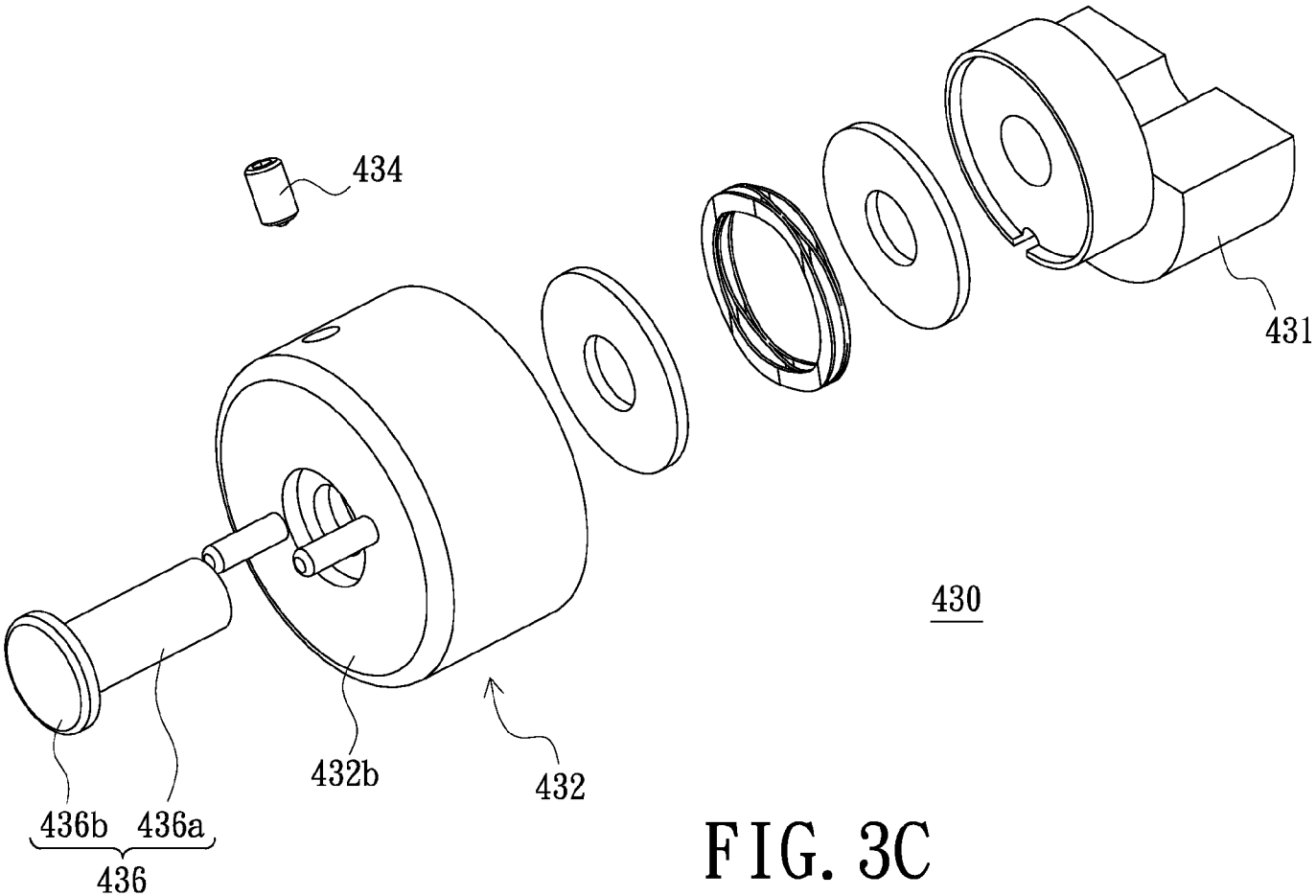
FIG. 3C is another schematic three-dimensional exploded view of the adjustable assembly of FIG. 3A.

FIG. 3A is a schematic cross-sectional view of an adjustable assembly of a third embodiment of the present invention. FIG. 3B is a schematic three-dimensional exploded view of the adjustable assembly of FIG. 3A. FIG. 3C is another schematic three-dimensional exploded view of the adjustable assembly of FIG. 3A. Referring to FIGS. 3A, 3B and 3C, the main difference between the adjustable assembly 430 of the third embodiment and each of the adjustable assemblies 330 of the second embodiment lies in that the adjustable assembly 430 further includes an auxiliary central shaft 436. The auxiliary central shaft 436 passes through the end wall 432*b* of the cap 432 to be fixed to the connection element 431.

Particularly, the auxiliary central shaft 436 includes a through portion 436*a* and an end portion 436*b*. The through portion 436*a* passes through the end wall 432*b* of the cap 432 to be fixed to the connection element 431. The end portion 436*b* is disposed at an end of the through portion 436*a*. At least part of the end wall 432*b* of the cap 432 is restricted between the end portion 436*b* of the auxiliary central shaft 436 and the connection element 431.

When the detachable fixing element 434 is detached, the housing (not shown), the connection element 431 and the auxiliary central shaft 436 are adapted to be rotated relative to the cap 432. At this time, because the cap 432 is restricted between the end portion 436*b* of the auxiliary shaft 436 and the connection element 431, the cap 432 can not be separated from the connection element 431 during the rotation of the housing.

Fourth Embodiment

Figure 4A:
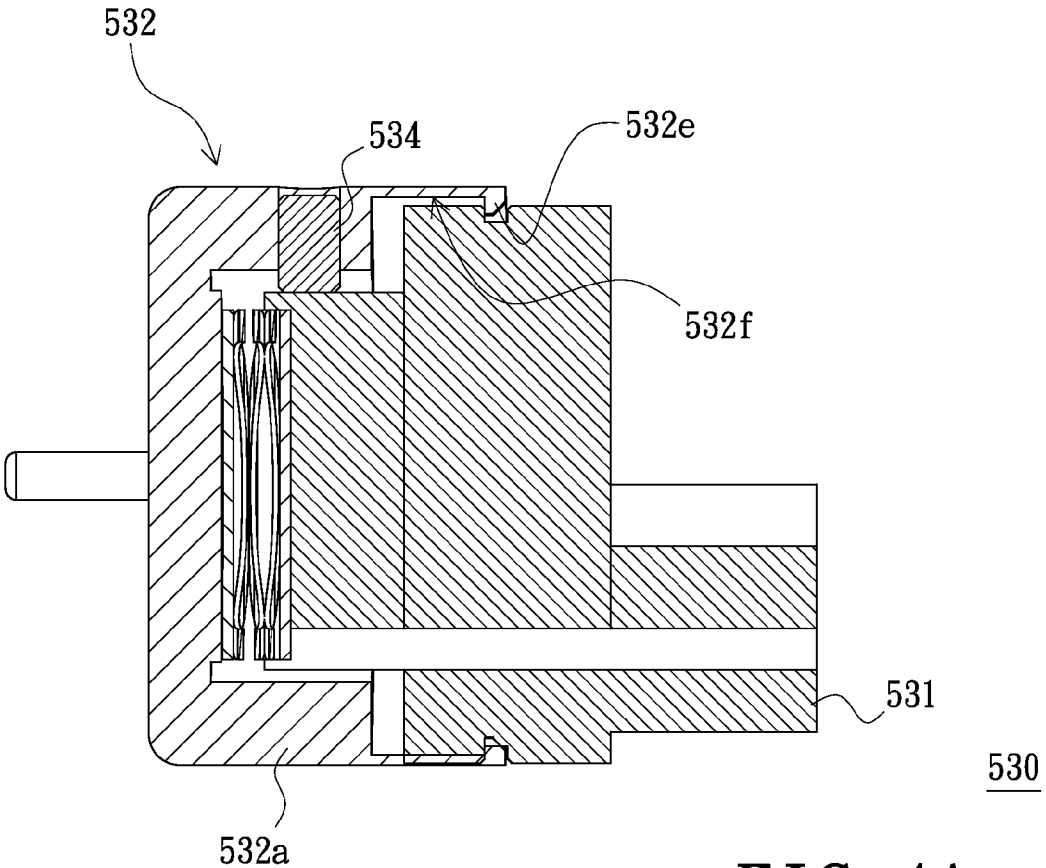
FIG. 4A is a schematic cross-sectional view of an adjustable assembly of a fourth embodiment of the present invention.
Figure 4B:
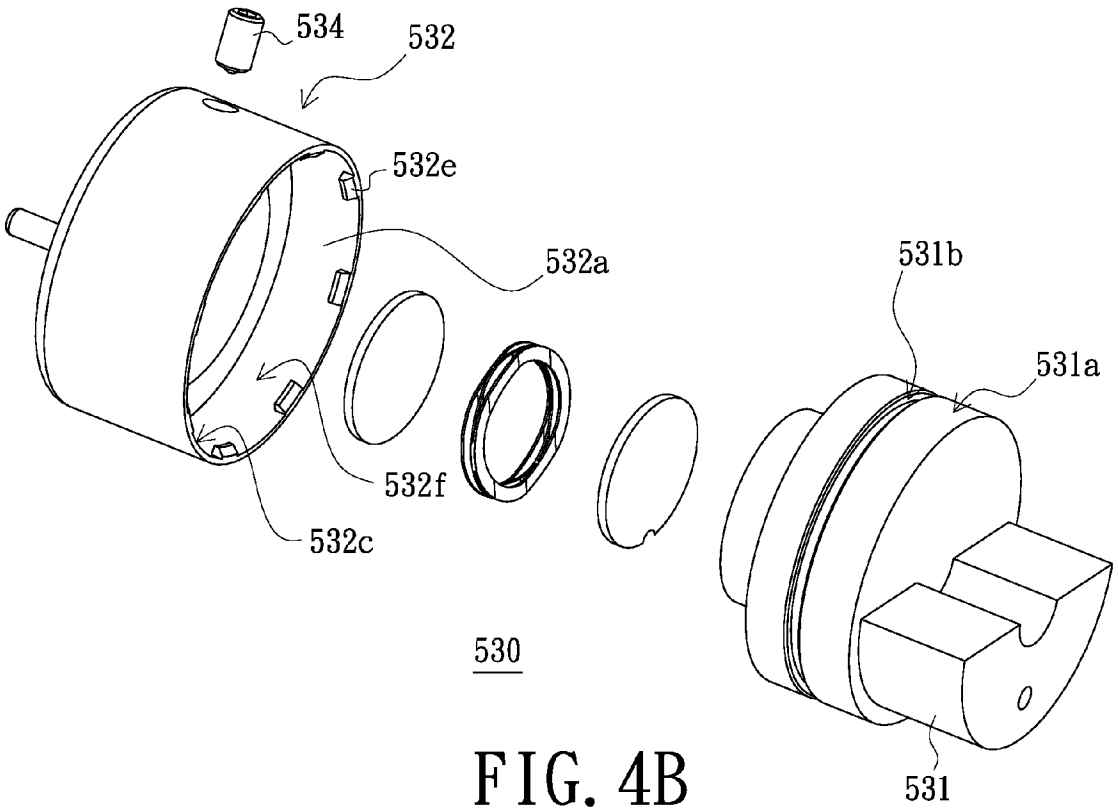
FIG. 4B is a schematic three-dimensional exploded view of the adjustable assembly of FIG. 4A.
Figure 4C:
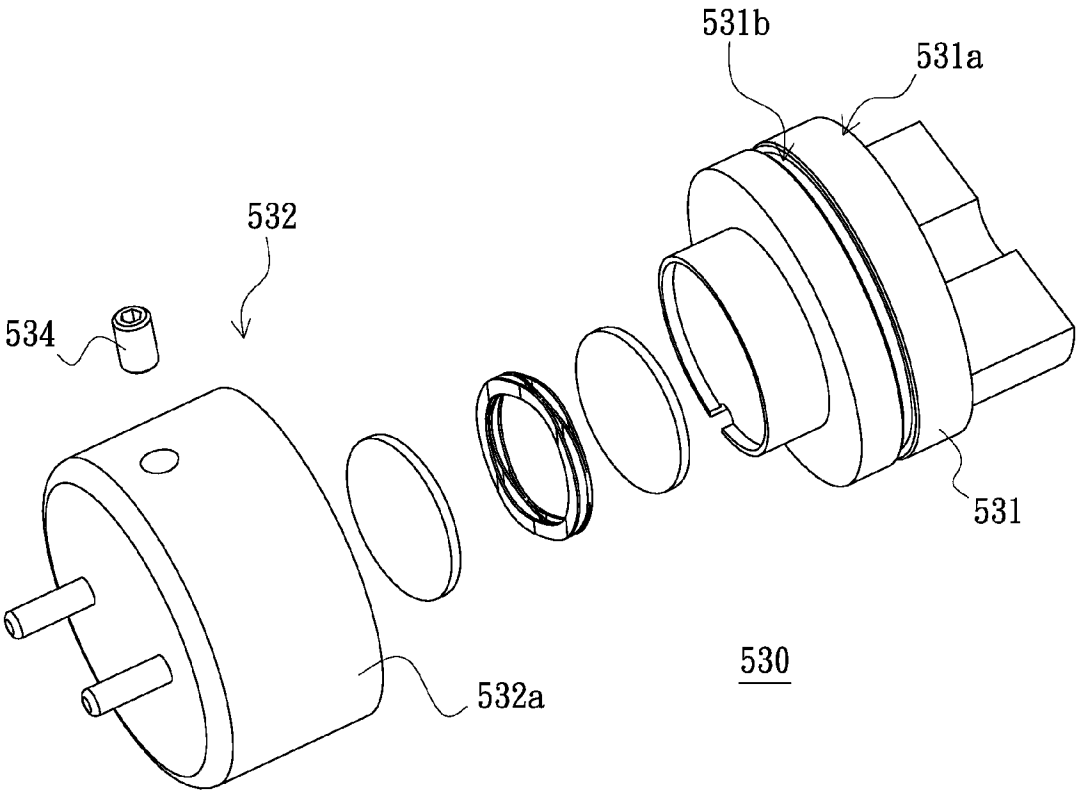
FIG. 4C is another schematic three-dimensional exploded view of the adjustable assembly of FIG. 4A.

FIG. 4A is a schematic cross-sectional view of an adjustable assembly of a fourth embodiment of the present invention. FIG. 4B is a schematic three-dimensional exploded view of the adjustable assembly of FIG. 4A. FIG. 4C is another schematic three-dimensional exploded view of the adjustable assembly of FIG. 4A. Referring to FIGS. 4A, 4B and 4C, the main difference between the adjustable assembly 530 of the fourth embodiment and each of the adjustable assemblies 330 of the second embodiment lies in that the cap 532 of the adjustable assembly 530 further includes a plurality of clasps 532*e* disposed at the side wall of 532*a* the cap 532.

Particularly, the clasps 532*e* are disposed at an inner surface 532*f* of the side wall 532*a* and adjacent to the opening 532*c*. The connection element 531 has a circular trench 531*b* disposed at an outer surface 531*a* of the connection element 531. The clasps 532*e* of the cap 532 clasp the circular trench 531*b* of the connection element 531.

When the detachable fixing element 534 is detached, the housing (not shown) and the connection element 531 are adapted to be rotated relative to the cap 532. At this time, because the clasps 532*e* of the cap 532 clasp the circular trench 531*b* of the connection element 531, the cap 532 can not be separated from the connection element 531 during the rotation of the housing.

Fifth Embodiment

Figure 5A:
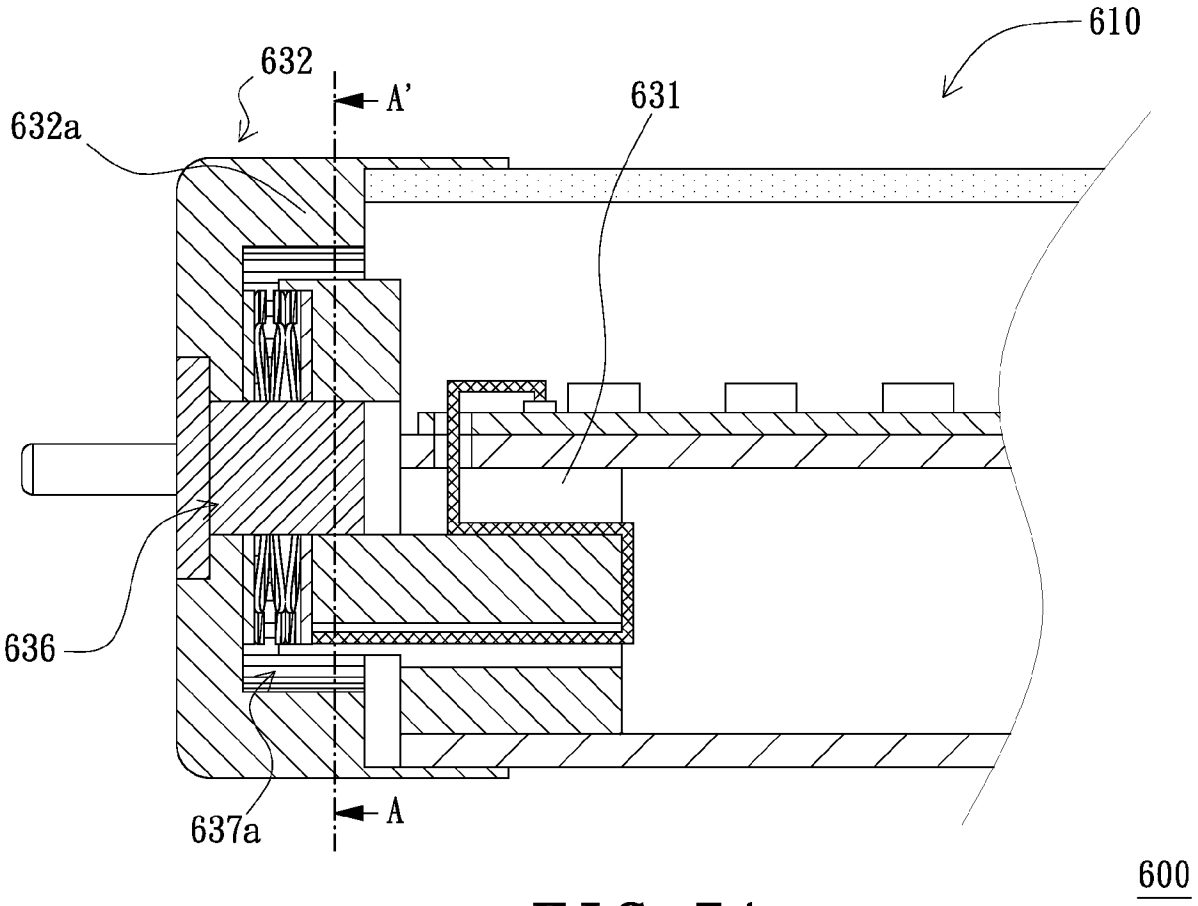
FIG. 5A is a schematic cross-sectional view of a lighting apparatus of a fifth embodiment of the present invention.
Figure 5B:
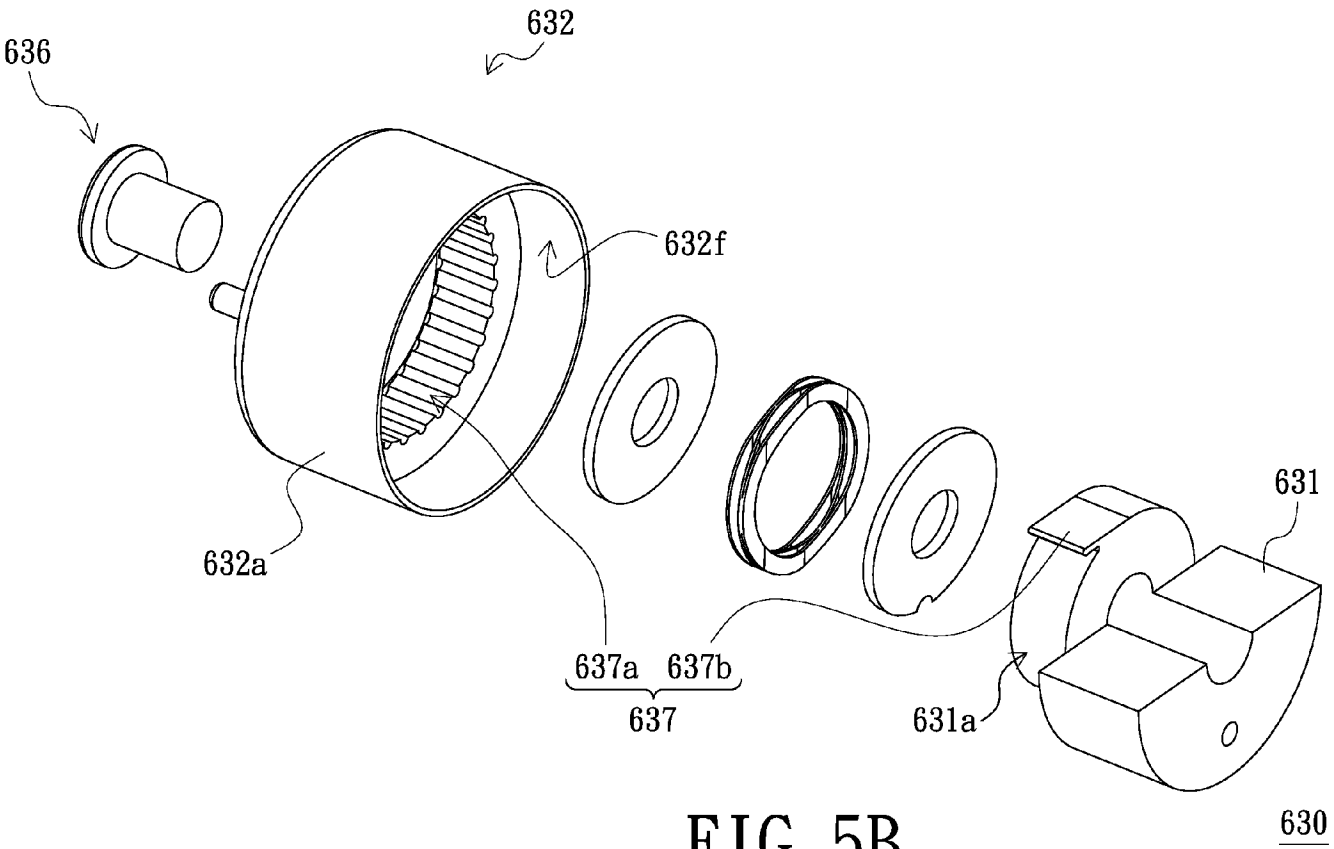
FIG. 5B is a schematic three-dimensional exploded view of the adjustable assembly of FIG. 5A.

FIG. 5A is a schematic cross-sectional view of a lighting apparatus of a fifth embodiment of the present invention. FIG.

Figure 5C:
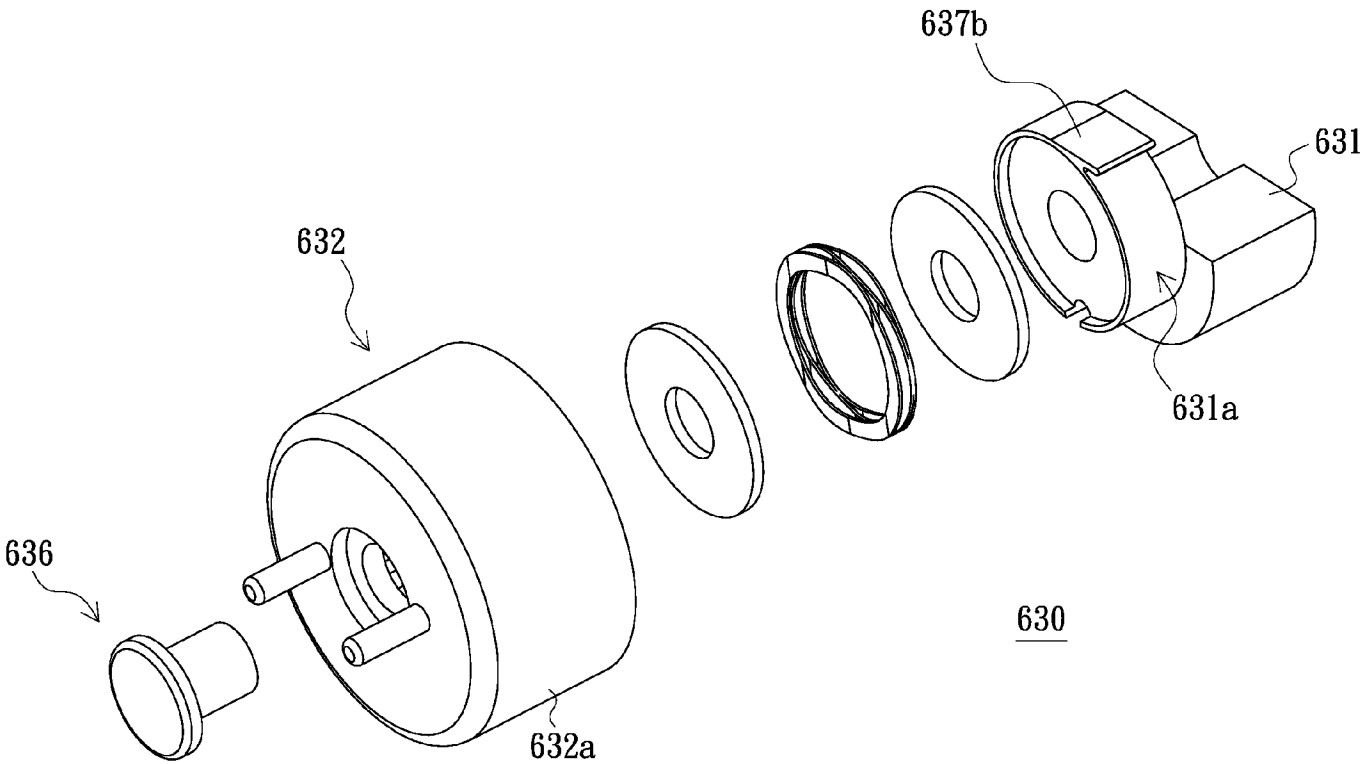
FIG. 5C is another schematic three-dimensional exploded view of the adjustable assembly of FIG. 5A.
Figure 5D:
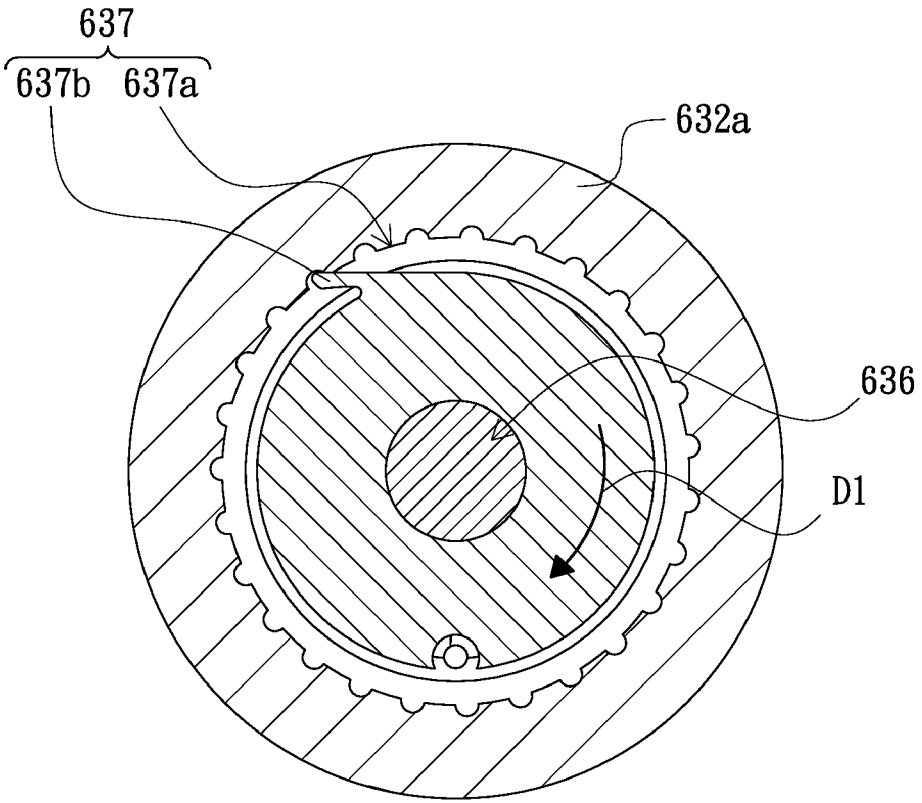
FIG. 5D is a schematic cross-sectional view of the lighting apparatus of FIG. 5A along the line A-A'.

5B is a schematic three-dimensional exploded view of the adjustable assembly of FIG. 5A. FIG. 5C is another schematic three-dimensional exploded view of the adjustable assembly of FIG. 5A. FIG. 5D is a schematic cross-sectional view of the lighting apparatus of FIG. 5A along the line A-A'. Referring to FIGS. 5A, 5B, 5C and 5D, the main difference between each of the adjustable assemblies 630 of the lighting apparatus 600 of the fifth embodiment and the adjustable assembly 430 of the third embodiment lies in that the detachable fixing element 434 is omitted and each of the adjustable assemblies 630 of the present embodiment further includes a ratchet 637.

In each of the adjustable assemblies 630, the ratchet 637 includes a gear 637*a* and a positioning element 637*b* engaged with the gear 637*a*. The gear 637*a*, such as an internal gear, is disposed at an inner surface 632*f* of the side wall 632*a* of the cap 632. The positioning element 637*b*, such as a pawl, is disposed at outer surface 631*a* of the connection element 631. The housing 610, the connection elements 631 and the auxiliary central shafts 636 are adapted to be rotated relative to the caps 632 in a rotational direction D1.

Because each of the adjustable assemblies 630 of the present embodiment further includes a ratchet 637 including the gear 637*a* and the positioning element 637*b* engaged with the gear 637*a*, the positioning element 637*b* generates resistance against the rotation of the teeth of the gear 637*a* during the rotation of the housing 610 to avoid over-rotation of the housing 610.

Sixth Embodiment

Figure 6A:
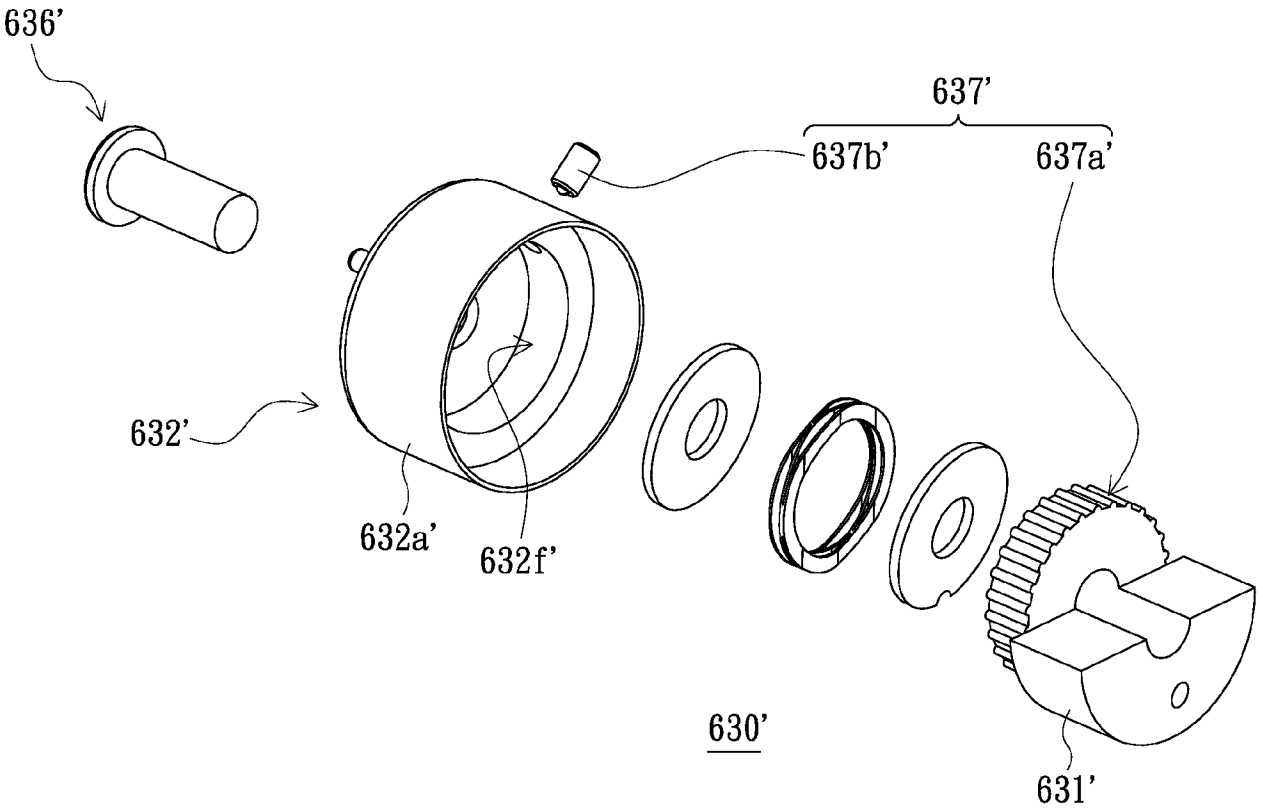
FIG. 6A is a schematic three-dimensional exploded view of an adjustable assembly of a sixth embodiment of the present invention.
Figure 6B:
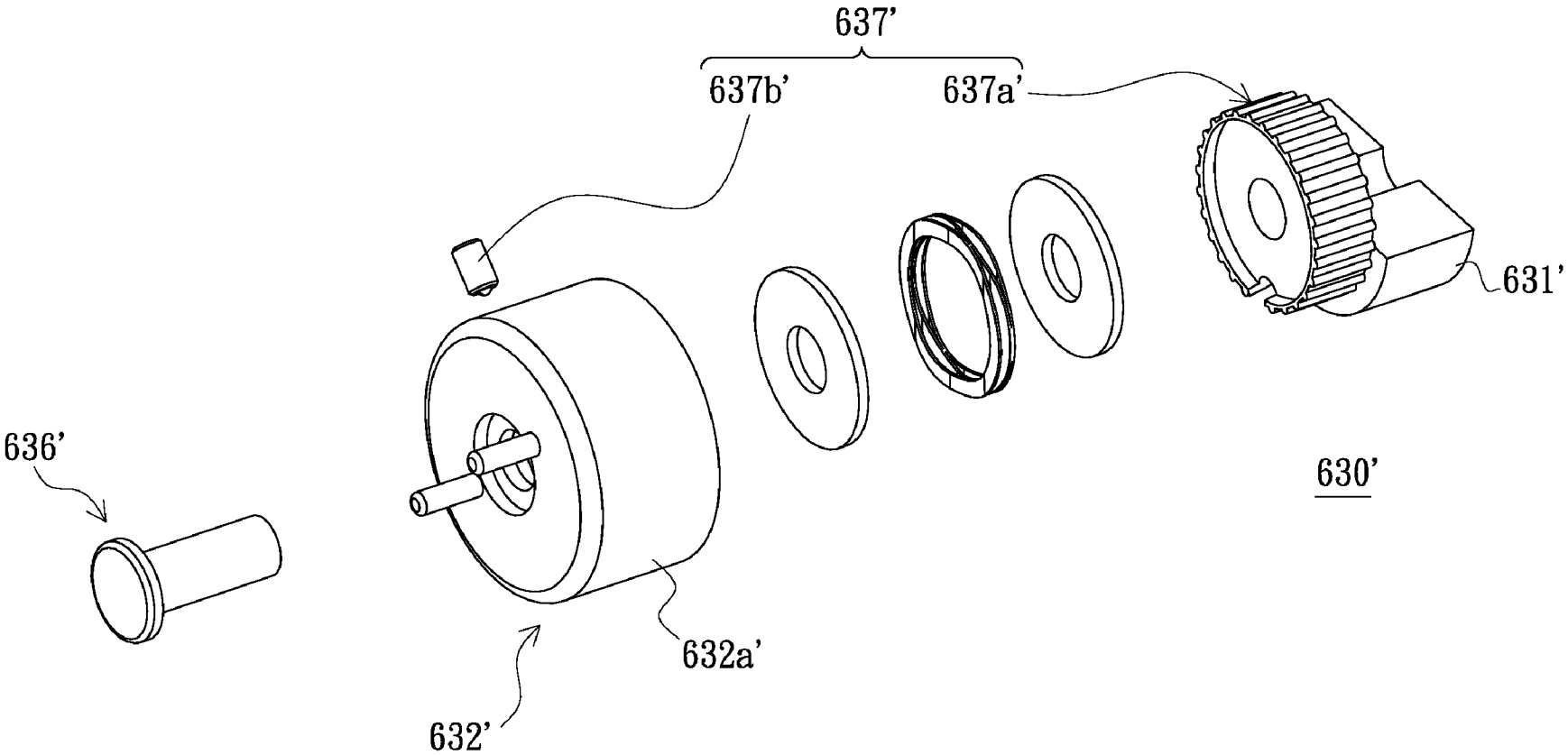
FIG. 6B is another schematic three-dimensional exploded view of the adjustable assembly of FIG. 6A.
Figure 6C:
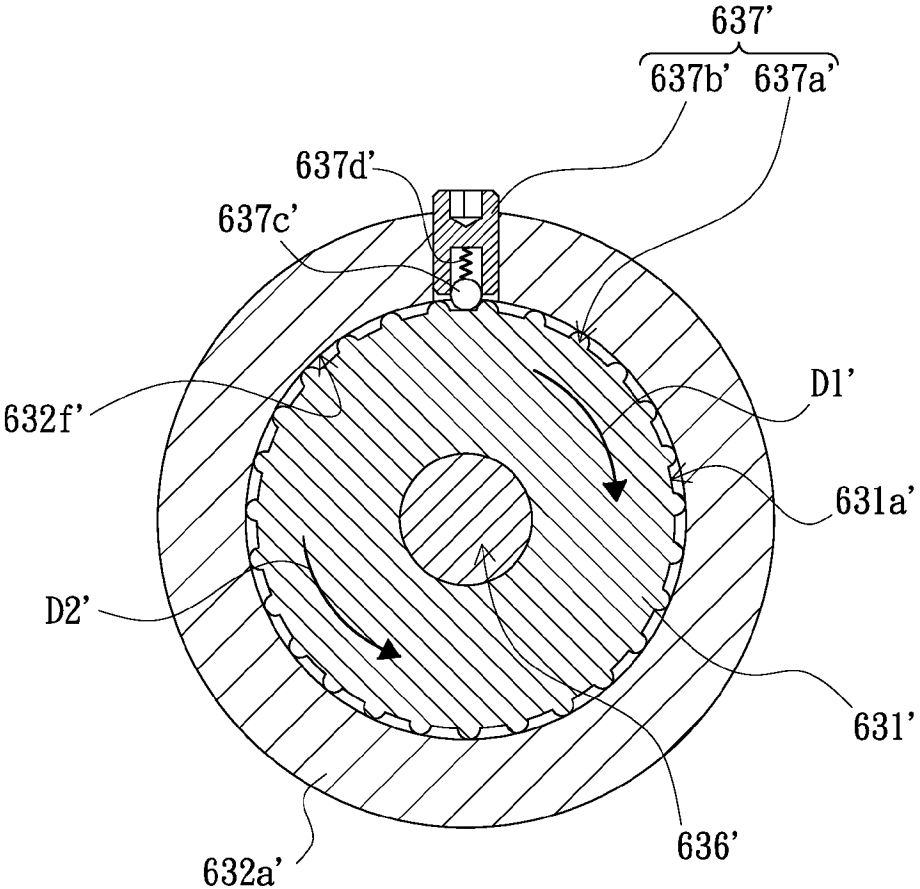
FIG. 6C is a schematic cross-sectional view of the adjustable assembly of the sixth embodiment of the present invention.

FIG. 6A is a schematic three-dimensional exploded view of an adjustable assembly of a sixth embodiment of the present invention. FIG. 6B is another schematic three-dimensional exploded view of the adjustable assembly of FIG. 6A. FIG. 6C is a schematic cross-sectional view of the adjustable assembly of the sixth embodiment of the present invention. Referring to FIGS. 6A, 6B and 6C, the main difference between the adjustable assembly 630' of the sixth embodiment and each of the adjustable assemblies 630 of the fifth embodiment lies in that the shape of the ratchet 637'.

The gear 637*a*' of the ratchet 637', such as an external gear, is disposed at the outer surface 631*a*' of the connection element 631'. The positioning element 637*b*' is disposed at the side wall 632*a*' of the cap 632' and extends from the inner surface 632*f* of the side wall 632*a*' into the cap 632'. In the present embodiment, the positioning element 637*b*', such as a stop screw including a ball 637*c*' and a spring 637*d*', passes through the side wall 632*a*' to be fixed to the side wall 632*a*'. The housing (not shown), the connection element 631' and the auxiliary central shaft 636' are adapted to be rotated relative to the cap 632' in a rotational direction D1' or another rotational direction D2'.

Seventh Embodiment

Figure 7A:
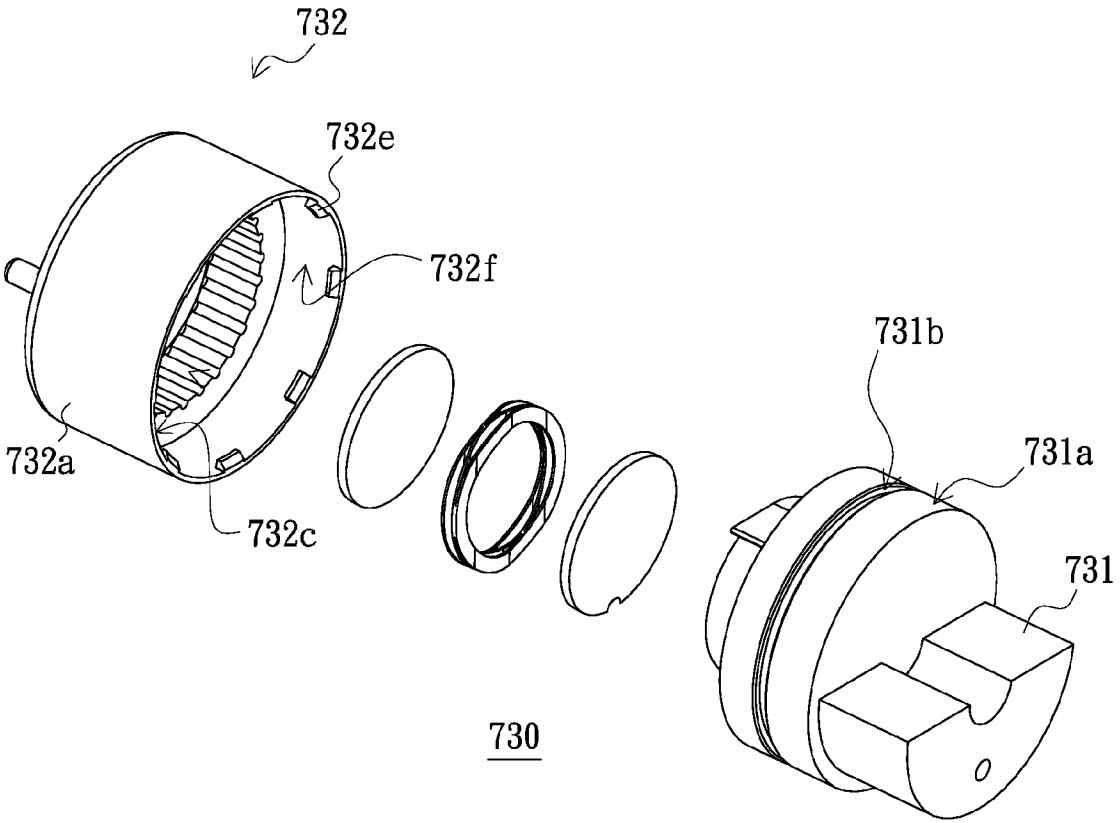
FIG. 7A is a schematic three-dimensional exploded view of the adjustable assembly of a seventh embodiment of the present invention.
Figure 7B:
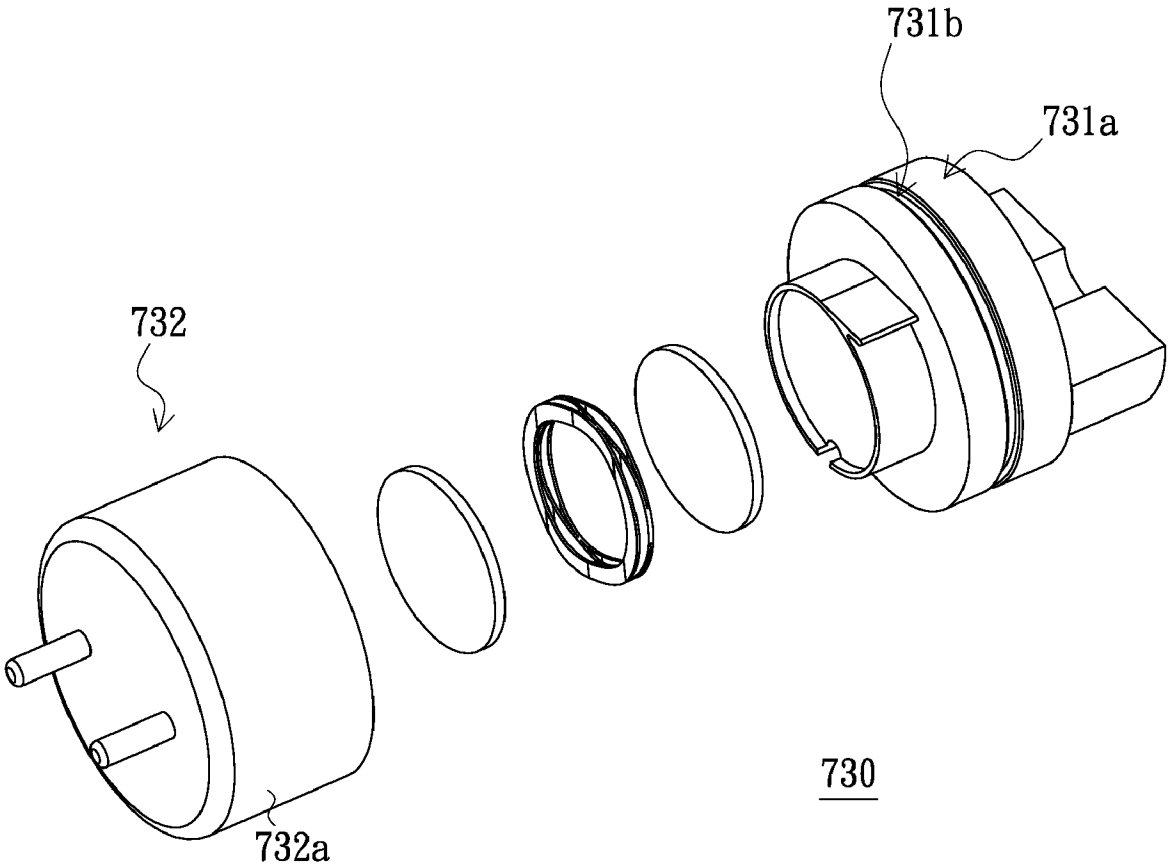
FIG. 7B is another schematic three-dimensional exploded view of the adjustable assembly of FIG. 7A.

FIG. 7A is a schematic three-dimensional exploded view of the adjustable assembly of a seventh embodiment of the present invention. FIG. 7B is another schematic three-dimensional exploded view of the adjustable assembly of FIG. 7A. Referring to FIGS. 7A and 7B, the main difference between the adjustable assembly 730 of the seventh embodiment and each of the adjustable assemblies 630 of the fifth embodiment lies in that the auxiliary shaft 636 is omitted and the cap 732 of the present embodiment further includes a plurality of clasps 732*e* disposed at the side wall 732*a* of the cap 732.

Particularly, the clasps 732*e* are disposed at an inner surface 732*f* of the side wall 732*a* and adjacent to the opening 732*c*. The connection element 731 has a circular trench 731*b* disposed at an outer surface 731*a* of the connection element 731. The clasps 732*e* of the cap 732 clasp the circular trench 731*b* of the connection element 731.

Eighth Embodiment

Figure 8A:
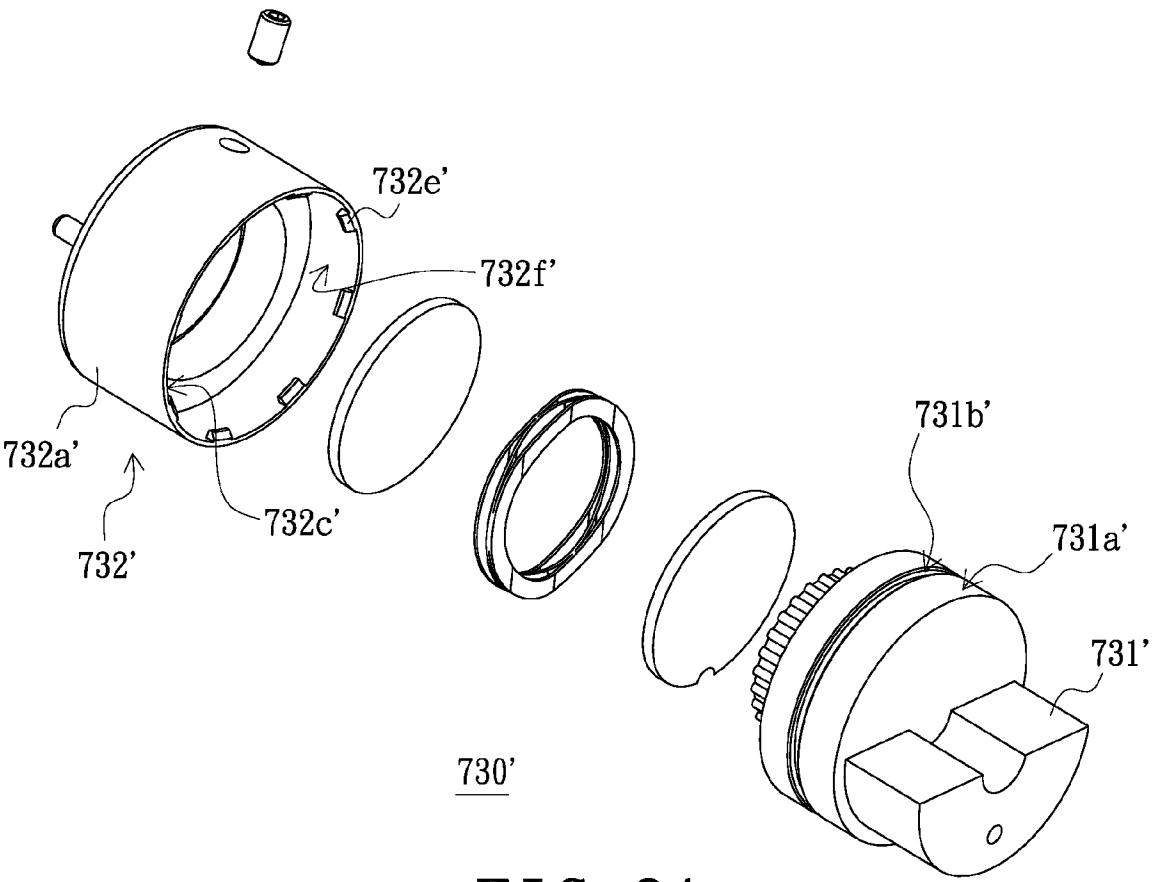
FIG. 8A is a schematic three-dimensional exploded view of the adjustable assembly of a seventh embodiment of the present invention.
Figure 8B:
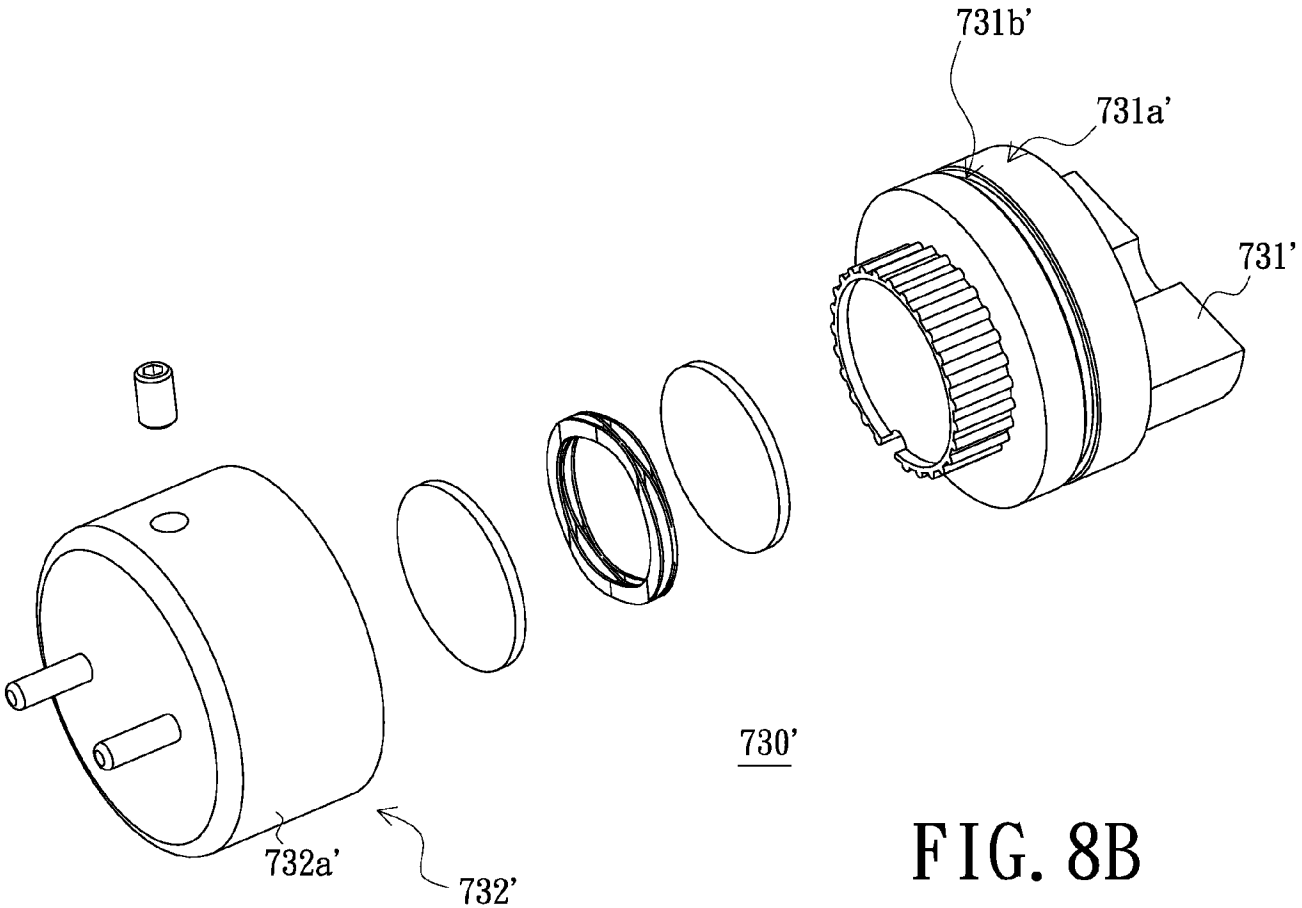
FIG. 8B is another schematic three-dimensional exploded view of the adjustable assembly of FIG. 8A.

FIG. 8A is a schematic three-dimensional exploded view of the adjustable assembly of a seventh embodiment of the present invention. FIG. 8B is another schematic three-dimensional exploded view of the adjustable assembly of FIG. 8A. Referring to FIGS. 8A and 8B, the main difference between the adjustable assembly 730' of the eighth embodiment and the adjustable assembly 630' of the sixth embodiment lies in that the auxiliary shaft 636' is omitted and the cap 732' of the present embodiment further includes a plurality of clasps 732*e*' disposed at the side wall of 732*a*' the cap 732'.

Particularly, the clasps 732*e*' are disposed at an inner surface 732*f*' of the side wall 732*a*' and adjacent to the opening 732*c*'. The connection element 731' has a circular trench 731*b*' disposed at an outer surface 731*a*' of the connection element 731'. The clasps 732*e*' of the cap 732' clasp the circular trench 731*b*' of the connection element 731'.

According to the above description, the lighting apparatus of each of the embodiments of the present invention at least has one of the following advantages or other advantages:

1. Because the housing and the connection element of the lighting apparatus of each of the embodiments can be rotated relative to the cap, the lighting apparatus of each of the embodiments is applicable to the present exiting light fixture and the light from the lighting source can be directed to illuminate the desired surface or area.

2. Because the adjustable assembly of the lighting apparatus of the embodiment of the present invention can further include the electrical conductive module disposed in the cap, the housing and the connection element of the lighting apparatus of the embodiment can be rotated about 360 angular degrees back and forth such that it is more convenient for the user to adjust the position of the housing and the direction of light from the light source.

3. Because the adjustable assembly of the lighting apparatus of the embodiment of the present invention can further include the auxiliary central shaft and the cap is restricted between the end portion of the auxiliary shaft and the connection element, the cap can not be separated from the connection element during the rotation of the housing.

4. Because the cap of the adjustable assembly of the lighting apparatus of the embodiment of the present invention can further include a plurality of clasps disposed at the side wall of the cap and the clasps clasp the connection element, the cap can not be separated from the connection element during the rotation of the housing.

5. Because the adjustable assembly of the embodiment of the present invention further includes a ratchet including the gear and the positioning element engaged with the gear, the positioning element generates resistance against the rotation of the teeth of the gear during the rotation of the housing to avoid over-rotation of the housing.

The above description is given by way of example, and not limitation. Given the above disclosure, one skilled in the art could devise variations that are within the scope and spirit of the invention disclosed herein, including configurations ways of the recessed portions and materials and/or designs of the attaching structures. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. A lighting apparatus comprising:

a housing;

a light source disposed in the housing; and at least one adjustable assembly disposed at an end of the housing and comprising:

a connection element fixed to the end of the housing;

a cap capping the connection element, wherein the cap comprises a side wall, an end wall and an opening, the side wall is disposed at the end wall, the opening is disposed at the side wall and opposite to the end wall, and the connection element passes through the opening;

at least one electrical terminal disposed at the end wall and extending outside the cap, wherein the electrical terminal is electrically connected to the light source; and a detachable fixing element passing through the side wall to detachably fix the cap to the connection element, wherein when the detachable fixing element is detached, the housing and the connection element are adapted to be rotated relative to the cap.

2. The lighting apparatus as claimed in claim 1, wherein the adjustable assembly further comprises an auxiliary central shaft passing through the end wall to be fixed to the connection element, when the detachable fixing element is detached, the housing, the connection element and the auxiliary central shaft are adapted to be rotated relative to the cap.

3. The lighting apparatus as claimed in claim 2, wherein the auxiliary central shaft comprises a through portion and an end portion, the through portion passes through the end wall to be fixed to the connection element, the end portion is disposed at an end of the through portion, and at least part of the end wall is restricted between the end portion and the connection element.

4. The lighting apparatus as claimed in claim 1, wherein the cap further comprises a plurality of clasps disposed at the side wall and the clasps clasp the connection element.

5. The lighting apparatus as claimed in claim 4, wherein the clasps are disposed at an inner surface of the side wall and adjacent to the opening.

6. The lighting apparatus as claimed in claim 1, wherein the adjustable assembly further comprises an electrical conductive module disposed in the cap, the electrical conductive module comprises a first disk, a second disk and a disk spring, the first disk is disposed at an inner surface of the end wall and electrically connected to the electrical terminal, the second disk is fixed to the connection element and electrically connected to the light source, and the disk spring disposed between the first disk and the second disk electrically connects the first disk and the second disk.

7. A lighting apparatus comprising:

a housing;

a light source disposed in the housing; and at least one adjustable assembly disposed at an end of the housing and comprising:

a connection element fixed to the end of the housing;

a cap capping the connection element, wherein the cap comprises a side wall, an end wall and an opening, the side wall is disposed at the end wall, the opening is disposed at the side wall and opposite to the end wall, and the connection element passes through the opening;

at least one electrical terminal disposed at the end wall and extending outside the cap, wherein the electrical terminal is electrically connected to the light source;

an auxiliary central shaft comprising a through portion and an end portion, wherein the through portion passes through the end wall to be fixed to the connection element, the end portion is disposed at an end of the through portion, at least part of the end wall is restricted between the end portion and the connection element, and the housing, the connection element and the auxiliary central shaft are adapted to be rotated relative to the cap; and a ratchet comprising a gear and a positioning element engaged with the gear, wherein the gear is disposed at an inner surface of the side wall and the positioning element is disposed at the connection element, or the gear is disposed at the connection element and the positioning element disposed at the side wall extends from the inner surface of the side wall into the cap.

8. The lighting apparatus as claimed in claim 7, wherein the adjustable assembly further comprises an electrical conductive module disposed in the cap, the electrical conductive module comprises a first disk, a second disk and a disk spring, the first disk is disposed at an inner surface of the end wall and electrically connected to the electrical terminal, the second disk is fixed to the connection element and electrically connected to the light source, and the disk spring disposed between the first disk and the second disk electrically connects the first disk and the second disk.

9. A lighting apparatus comprising:

a housing;

a light source disposed in the housing; and at least one adjustable assembly disposed at an end of the housing and comprising:

a connection element fixed to the end of the housing;

a cap capping the connection element, wherein the cap comprises a side wall, an end wall, an opening and a plurality of clasps, the side wall is disposed at the end wall, the opening is disposed at the side wall and opposite to the end wall, the clasps are disposed at the side wall, the connection element passes through the opening, the clasps clasp the connection element, and the housing and the connection element are adapted to be rotated relative to the cap;

at least one electrical terminal disposed at the end wall and extending outside the cap, wherein the electrical terminal is electrically connected to the light source; and a ratchet comprising a gear and a positioning element engaged with the gear, wherein the gear is disposed at an inner surface of the side wall and the positioning element is disposed at the connection element, or the gear is disposed at the connection element and the positioning element disposed at the side wall extends from the inner surface of the side wall into the cap.

10. The lighting apparatus as claimed in claim 9, wherein the clasps are disposed at the inner surface of the side wall and adjacent to the opening.

11. The lighting apparatus as claimed in claim 9, wherein the adjustable assembly further comprises an electrical conductive module disposed in the cap, the electrical conductive module comprises a first disk, a second disk and a disk spring, the first disk is disposed at an inner surface of the end wall and electrically connected to the electrical terminal, the second disk is fixed to the connection element and electrically connected to the light source, and the disk spring disposed between the first disk and the second disk electrically connects the first disk and the second disk.

* * * * *